US006272690B1

(12) United States Patent
Carey et al.

(10) Patent No.: US 6,272,690 B1
(45) Date of Patent: Aug. 14, 2001

(54) HEAD COVERING

(76) Inventors: Michael J. Carey, 6817 Elaine Way, San Diego, CA (US) 92120; Joseph H. Edwards, 2479 E. Field Rose La., Salt Lake City, UT (US) 84121

( * ) Notice: Subject to any disclaimer, the term of this patent is extended or adjusted under 35 U.S.C. 154(b) by 0 days.

(21) Appl. No.: 08/619,269

(22) Filed: Mar. 18, 1996

Related U.S. Application Data

(63) Continuation of application No. 08/344,373, filed on Nov. 23, 1994.

(51) Int. Cl.[7] ..... A41D 13/00

(52) U.S. Cl. ..... 2/206; 2/9; 2/171; 2/173; 2/207

(58) Field of Search ..... 2/9, 171, 173, 2/200.1, 200.2, 202, 205, 206, 207, 410, 424, 203

(56) References Cited

U.S. PATENT DOCUMENTS

| | | | |
|---|---|---|---|
| D. 327,339 | | 6/1992 | Rasmussen et al. . |
| D. 339,676 | | 9/1993 | Geving . |
| 557,625 | | 4/1896 | Tolle . |
| 731,135 | | 6/1903 | Scott . |
| 766,963 | | 8/1904 | Murray . |
| 772,148 | | 10/1904 | Hughes . |
| 805,052 | | 11/1905 | Brooks . |
| 825,170 | | 7/1906 | Allen . |
| 891,122 | | 6/1908 | Wilcox . |
| 960,520 | | 6/1910 | Dysthe . |
| 1,023,677 | | 4/1912 | Pass . |
| 1,035,217 | | 8/1912 | McQuary, Jr. . |
| 1,235,927 | | 8/1917 | Sanborn . |
| 1,309,783 | | 7/1919 | Slawin . |
| 1,655,440 | | 1/1928 | Soble . |
| 1,990,199 | | 2/1935 | Nemzek . |
| 2,039,478 | * | 5/1936 | Ensten ..... 2/205 |
| 2,276,612 | | 3/1942 | Ellis . |
| 2,353,025 | | 7/1944 | Gautreaux . |
| 2,573,537 | | 10/1951 | Bouffard . |
| 2,716,981 | | 9/1955 | More . |
| 3,271,781 | | 9/1966 | Sontag et al. . |
| 3,665,517 | | 5/1972 | Hyman . |
| 3,668,705 | | 6/1972 | Garbisch . |

(List continued on next page.)

FOREIGN PATENT DOCUMENTS 366884 10/1906 (FR) .

OTHER PUBLICATIONS

Gator Catalog.
Seirus Outdoor Stuff catalog.
Ad and instructions for use of the mask, extreme cold weather.
Photograph of a person wearing a mask.
Photograph of a person wearing a mask.
Frontline catalog and price list 1990–1991.
Seirus gloves and accessories catalog.
Seirus skiing, skating, hiking, biking, running and hunting catalog.
Primos masks & accessories product list.
Seirus skiing, skating, hiking, biking, running, outdoor and athletic catalog—1993.

*Primary Examiner*—John J. Calvert
*Assistant Examiner*—Katherine Moran
(74) *Attorney, Agent, or Firm*—Holme Roberts & Owen LLP

(57) ABSTRACT

An article of clothing includes a mask member with a head member joined together to define an opening that registers with the eyes. The mask member is formed of neoprene with a fleece material laminated to the interior thereof. The head member is formed of a fleece material and has a scarf portion extending below the head to surround the neck area of the user.

1 Claim, 4 Drawing Sheets

U.S. PATENT DOCUMENTS

| | | | | |
|---|---|---|---|---|
| 3,678,929 | | 7/1972 | Buscher . | |
| 3,725,956 | * | 4/1973 | Reisen | 2/171 |
| 3,740,767 | | 6/1973 | Schuessler . | |
| 3,768,100 | | 10/1973 | Colman et al. . | |
| 3,823,418 | | 7/1974 | Piper . | |
| 3,878,563 | | 4/1975 | Pulju . | |
| 3,943,575 | | 3/1976 | Bolker . | |
| 4,095,290 | | 6/1978 | Obrien . | |
| 4,180,868 | | 1/1980 | Snow . | |
| 4,250,577 | | 2/1981 | Smith . | |
| 4,259,748 | | 4/1981 | Miller . | |
| 4,300,240 | | 11/1981 | Edwards . | |
| 4,641,379 | | 2/1987 | Martin . | |
| 4,886,079 | | 12/1989 | Mooney . | |
| 4,941,211 | | 7/1990 | Blutstein . | |
| 5,035,006 | | 7/1991 | Hetz et al. . | |
| 5,058,211 | | 10/1991 | Hanks . | |
| 5,062,163 | | 11/1991 | Avey . | |
| 5,109,548 | * | 5/1992 | Balaban et al. | 2/173 |
| 5,214,804 | | 6/1993 | Carey et al. . | |
| 5,251,336 | * | 10/1993 | Nevins | 2/173 |

* cited by examiner

HEAD COVERING

This application is a continuation of application Ser. No. 08/344,373, filed Nov. 23, 1994.

BACKGROUND OF THE INVENTION

1. Field of the Invention

This invention relates to articles of clothing and more particular to articles of clothing to be worn about the head.

2. State of the Art

Masks have been used in the past to protect a user's face from inclement weather. For example, U.S. Pat. No. 4,300,240 (Edwards) discloses a closed-cell neoprene mask which may be worn about the face to protect the user from adverse weather including wind, cold, rain, snow and the like. Gator Sports, Inc. of Salt Lake City, Utah also manufactures and sells a "Gator Face Protector," which is made from neoprene and positioned about the face to protect the user from adverse weather.

Other articles of clothing have been devised to protect the face from inclement weather. For example, a "balaclava" head protector is made for positioning over the head of the user. A balaclava is formed with a scarf portion that extends directly downward. It also has an opening that extends in height from the forehead to the chin area and in width the entire width of the face. U.S. Pat. No. 1,023,677 (Pass) shows a hood which is placed about the head. The hood is designed with an opening at the top and a fastening structure along the rear. Appropriate apertures are provided for the nose and eyes. Other articles of clothing include ear protectors, neck scarfs or "gaitors" and combination mask and scarf structures such as the GATOR DUO face protector manufactured by Gator Sports, Inc. of Salt Lake City, Utah and a COMBOSCARF sold by Seirus Innovative Accessories, Inc. of Salt Lake City, Utah. A combination mask and scarf structure is also disclosed in U.S. Pat. No. 5,214,804 (Carey, et al.).

Other head and face protecting devices are known including those shown in U.S. Pat. Nos. 5,731,135 (Scott), 5,766,963 (Murray), 1,309,783 (Slawin), 3,271,781 (Sontag, et al.), 3,665,517 (Hyman).

SUMMARY OF THE INVENTION

An article of clothing has a mask member formed of an insulative and wind-resistant material. The mask member is formed and sized to cover a portion of the face of the user The mask member has a perimeter which includes an upper edge for positioning under the eyes of the user and a lower edge for positioning below the mouth of the user to extend away therefrom. A head member is connected to the mask member. The head member is formed of a pliable material sized for positioning about the head. The head member is connected to the mask member along at least a portion of the perimeter of the mask member. The head member has a head edge formed proximate or for positioning proximate the eyebrows of the user. The head edge is spaced from the upper edge of the mask member a distance sufficient to define an eye opening to register with the eyes of the user.

The head member is preferably sized and shaped to substantially surround the head of the user rearwardly from the mask member. In a preferred arrangement, the article of clothing includes a scarf portion which is associated with or formed unitarily with the head member to extend downwardly from the head member to be positioned proximate the neck of the user.

In alternate configurations the head member may be sized and shaped to entirely surround the head of the user rearwardly from the mask member. The perimeter of the mask member may also optionally have a left outside edge and a right outside edge both of which extend upwardly toward the upper edge of the mask member. The head edge is preferably positioned proximate the eyebrows of a user to define an eye opening having a height which is selected to be less than the height of protective sport goggles.

In an alternate configuration, the head member is formed to have a neck opening sized and shaped to fit over the head of the user. The head member is formed of an elastic material so the neck opening may elastically expand and elastically retract to closely fit about the user's head and neck. Desirably, the mask member has a middle edge desirably positioned above the mouth and below the nose of the user. The mask member also has an a proximate the nose of the user and a selective aperture arrangement for positioning proximate the mouth of the user.

In another arrangement, the mask member has a lower edge that extends under the chin of the user. In yet an alternate configuration the mask member has at least one seam that extends from the middle edge towards the lower edge. The upper edge of the mask member extends contouredly over the nose and along the eye socket area of the eyes of the user.

In preferred configurations the mask member is formed of a neoprene-like material. A fleece-like material may be laminated to the interior portion thereof for contact with the face of a user. The head member and scarf member may be formed of a fleece-type material. Alternately the mask member may be formed of a Spandex™-type material.

BRIEF DESCRIPTION OF THE DRAWINGS

In the drawings which illustrate what is presently regarded as the best mode for carrying out the invention.

DETAILED DESCRIPTION OF THE ILLUSTRATED EMBODIMENT

Figure 1:
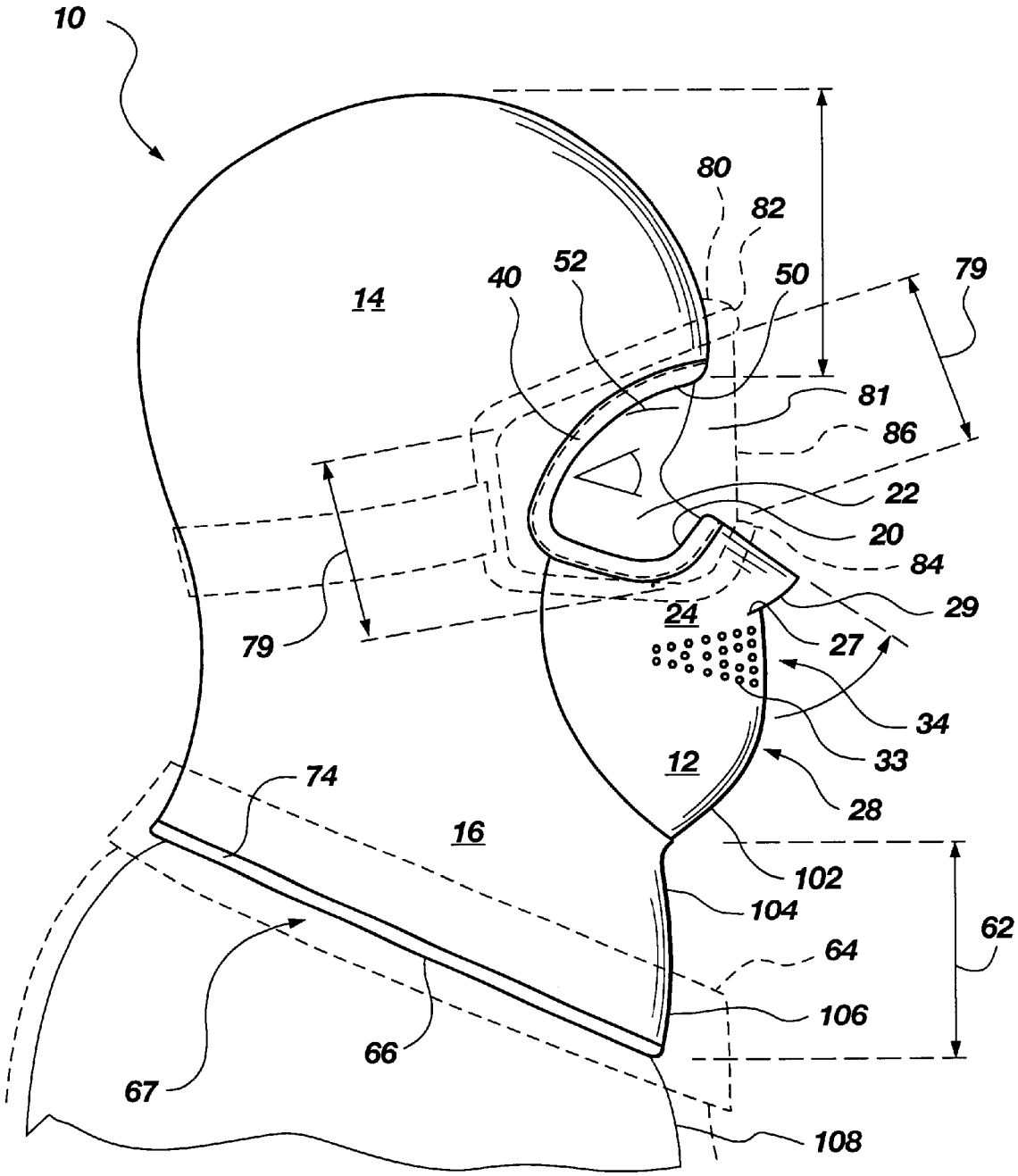
FIG. 1 is a side view of an article of clothing of the instant invention.
Figure 2:
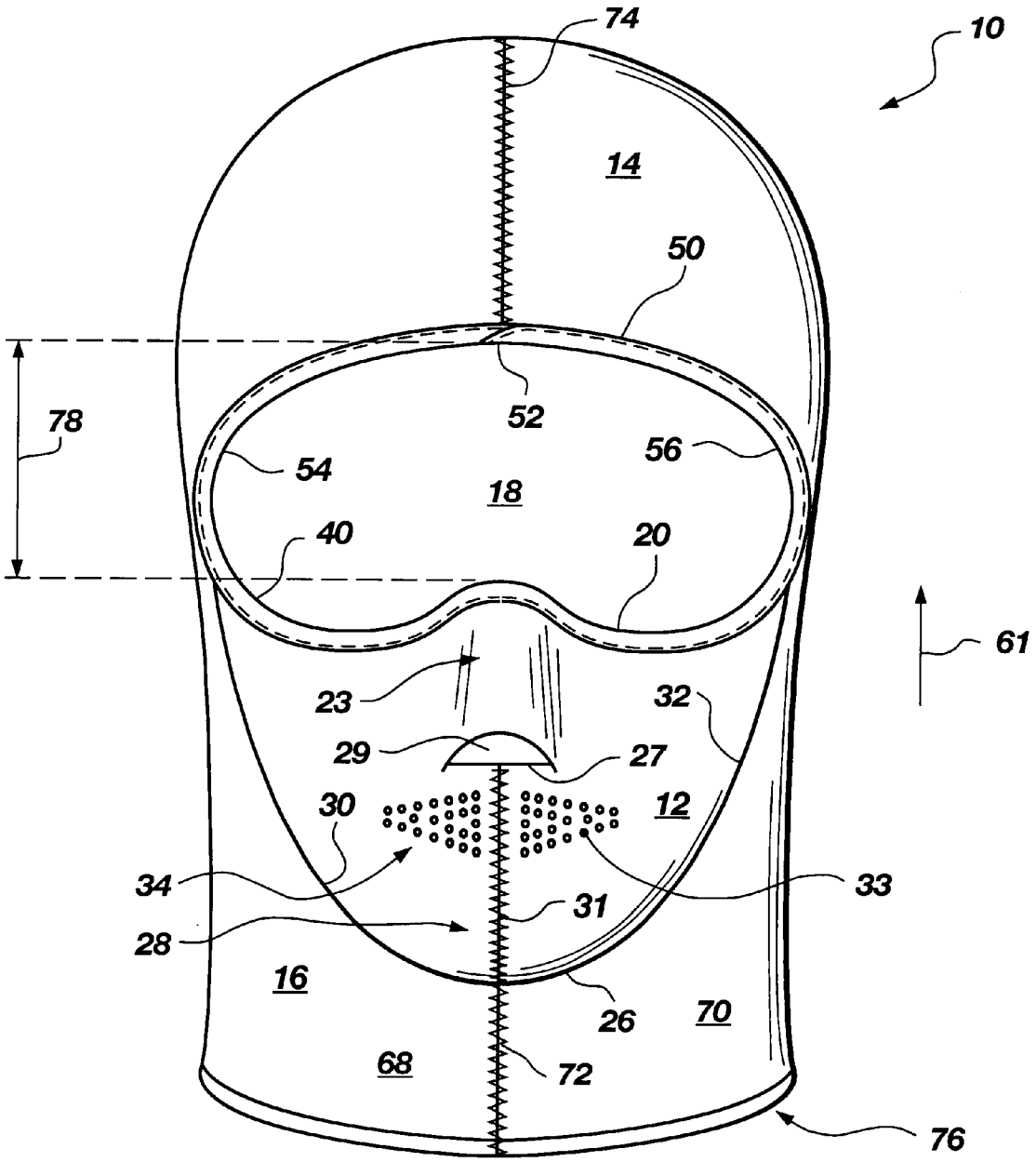
FIG. 2 is a front view of the article of clothing of FIG. 1.

In FIGS. 1 and 2, the article of clothing 10 has a protective mask member 12 in combination with a head member 14 and a scarf portion 16. The mask member 12 is attached to and combined with the head member 14 to provide an article of clothing to substantially surround the head of the user with an opening 18 to register with the eyes of a user. The scarf portion 16 may be separately attached to or unitarily formed with the head member 14 for positioning about or proximate the neck of a user as illustrated in FIG. 1.

The mask member 12 of FIG. 1 has an upper edge 20 which is here shown to be formed and sized to extend along the lower portion of the eye socket areas 22 of the user and over the bridge of the nose. More specifically, the mask member 12 is shaped to extend contouredly along the upper portion of the cheek bone area 24 and along the bottom of the eye socket areas 22 to extend over the bridge 23 of the nose.

As better seen in FIG. 2, the mask member 12 has a lower edge 26 which extends as here shown under the chin 28 and upwardly to form a left edge 30 and a right edge 32. The left edge 30 and the right edge 32 intersect the upper edge 20 of the mask member 12 to in turn define a perimeter of the mask member. The lower edge 26, the left edge 30 and the right edge 32 together are secured to the head member 14 with the scarf portion 16 to form the article of clothing as hereinbefore stated. The mask member 12 has a middle edge 27 formed for positioning above the lip and under the nose. The mask member 12 is formed to have an opening 29 to register with the nose. A center seam 31 (or multiple seams with inserts) may extend from the middle edge 27 to facilitate formation of the opening 29. Further, a separate opening arrangement 33 may be formed for positioning proximate the mouth 34.

Figure 7:
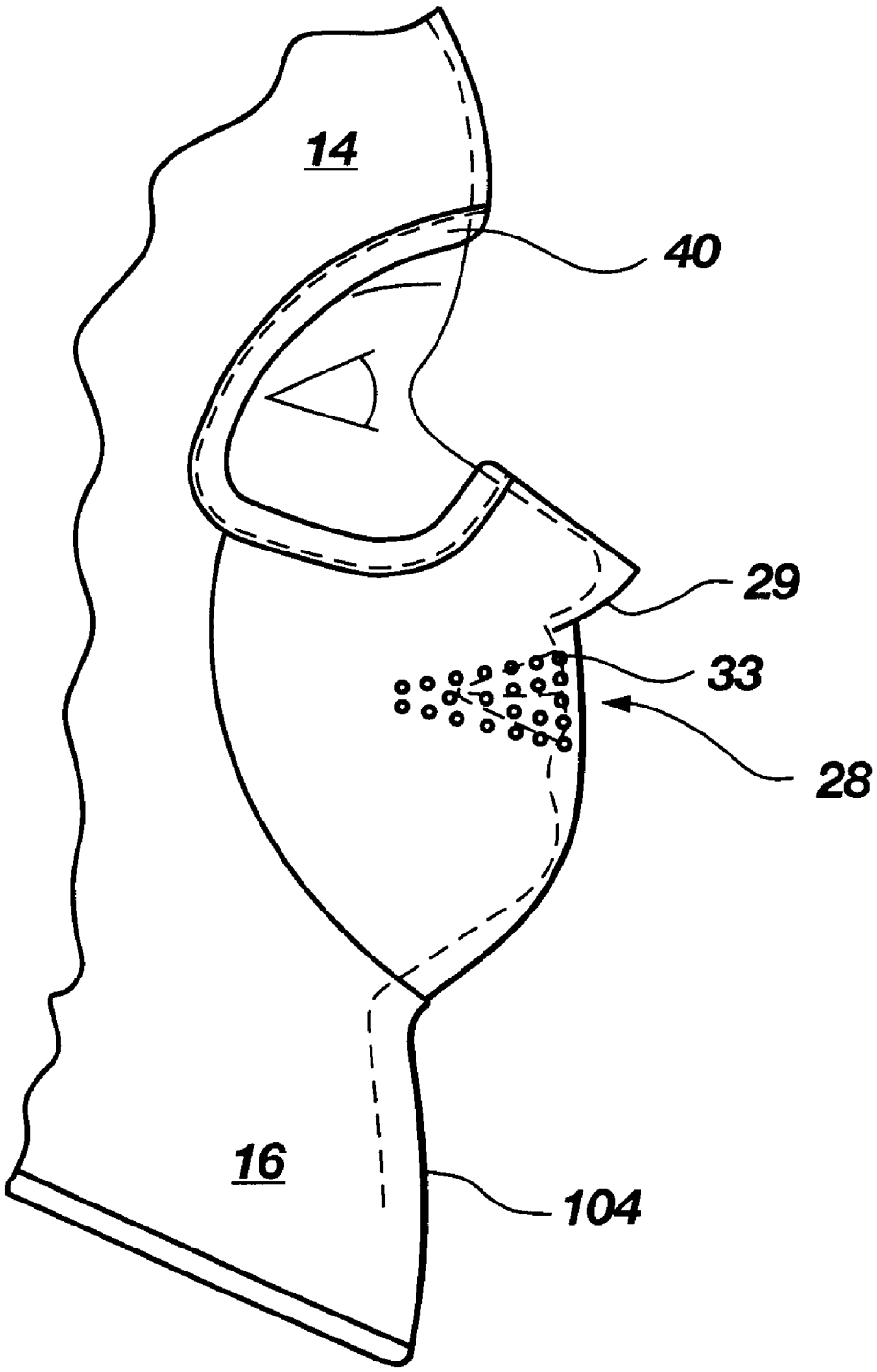
FIG. 7 is a partial side view of an alternate embodiment of the present invention

It may be here noted hat the lower edge 26 is shown extending under the chin 28. It should be understood that the lower edge 26 may be formed to be positioned at any reasonable location desired below the mouth area 34 of the user. For example, as seen in FIG. 7, the lower edge is above the chin 28 and below the mouth area 34. Further, the lower edge 26 is here shown extending arcuately into the left edge 30 and right edge 32 for further arcuate extension upward for interconnection with the upper edge 20. It may be noted that the lower edge 26 may be of other geometrical configuration including a straight edge. Further, the left edge 30 and right edge 32 may extend rearwardly and upwardly in any geometric configuration desired by the user. The mask member 12 defined by the edges such as lower edge 26, left edge 30, right edge 32 and upper edge 20 may be in a variety of geometrical configurations selected by the user with sufficient material to substantially protect the lower portion of the face under the eye socket areas.

Figure 3:
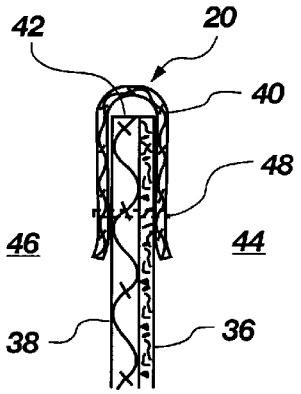
FIG. 3 is a partial cross-sectional view of an edge of the article of clothing of FIG. 1.

In the configurations of FIGS. 1 and 2, the mask member 12 is desirably formed of a closed cell neoprene material. Other materials can be laminated to the interior surface of the closed cell neoprene to contact the face or skin of the user. In the instant configuration, a fleece material 36 is laminated to the closed cell neoprene 38. Also, as seen in FIG. 3, piping material 40 is shown stitched to the cut edge 42 of the neoprene material 38 to form the upper edge 20. That is, the piping 40 as shown in FIG. 3 extends from the interior 44 to the exterior 46. The piping 40 is stitched by thread 48 to secure the piping 40 over the cut edge 42 as seen in FIG. 3. The piping 40 is made of an elastic material to be elastically deformable with the neoprene material of the mask member 12.

As better seen in FIGS. 1 and 2, the head member 14 is here shown to substantially surround the head of the user to define with the mask member 12 an article that completely surrounds the head of the user but for an opening 18 that registers with the eye area of the user. The head member 14 has a head edge 50 which is formed to be positioned approximate the eyebrows or eyebrow area 52 of the user. The head edge 50 extends outwardly as better seen in FIG. 2 to preferably intersect with or connect to the upper edge 20 of the mask member 12. The piping 40 extends from the upper edge 20 and along the head edge 50. Although the piping 40 may be positioned in segments, it is preferable to have a unitary piece of piping extend from a beginning point 52 continuously around the perimeter of the opening 18 defined by the head edge 50 and the upper edge 20. More specifically, the piping 40 extends continuously from the beginning 52 outwardly to the left side 54 area of the opening 18 and then contouredly along the upper edge 20 of the mask member 12 to the right side area 56 of the opening 18 and then contouredly back to the beginning 52.

Figure 4:
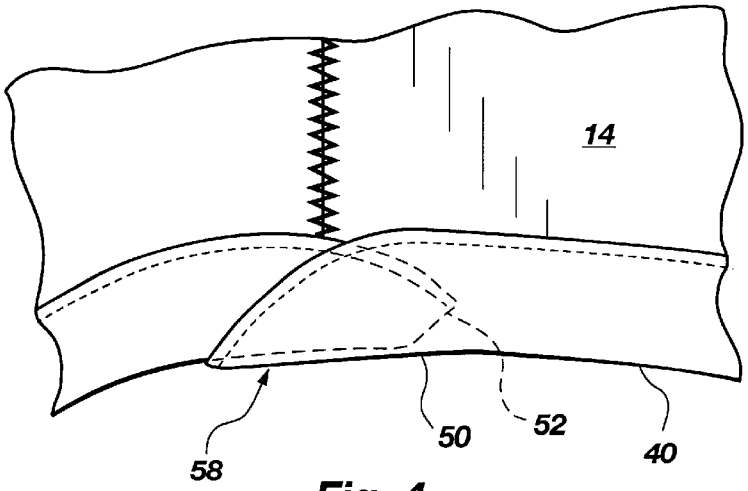
FIG. 4 is a partial enlarged view of a portion of the outside of an edge of an article of clothing shown in FIG. 1.
Figure 5:
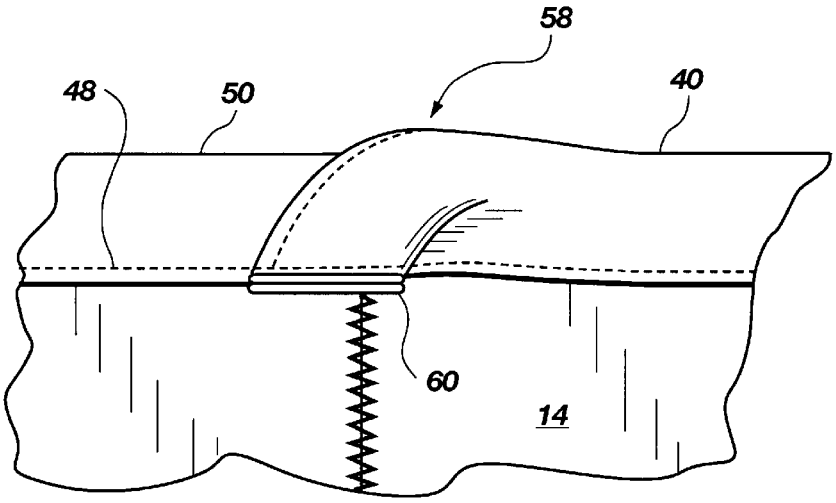
FIG. 5 is a partial inside view of a portion of the edge of an article of clothing shown in FIG. 1.

FIGS. 4 and 5 are substantially enlarged views of the piping 40 connected to the head member 14 along the upper edge 50. More specifically, the piping 40 has a beginning 52 which then can extend along the head edge 50 and the upper edge 20 has hereinbefore discussed returning to the area of the beginning to form an ending 58. FIG. 4 shows the beginning 52 and the ending 58 as seen from a position looking at the head member 14 from the outside thereof. FIG. 5 shows the inside of the head member 14 and shows the ending 58 leading to a configuration in which the outside and inside portions of the piping are gathered together in a fold 60 to be held in place by the stitching 48 of the piping 40.

It may be noted that the preferred head, member 14 is formed of a fleece material which may be POLAR TEC™ obtained from Malden Mills Industries, Inc., P.O. Box 809, Lawrence, Mass. 04842. Other materials with similar characteristics which include warmth and biaxial elasticity may be selected. The materials should be preferably closely woven to reduce or minimize the transmission of heat and in turn retain heat to provide the user with the warmth and comfort desired in adverse weather conditions. The mask member 12 is also formed out of the material that is preferentially biaxially deformable. The piping 40 is also elastically deformable generally in an axial fashion or along the edge 20 and 50 of the opening 18.

It may be noted that the mask member 12 may also be formed of a Spandex™-type material which is also wind resistant and water resistant while being elastically deformable to facilitate fitting to user and to increase the comfort for the user.

Figure 6:
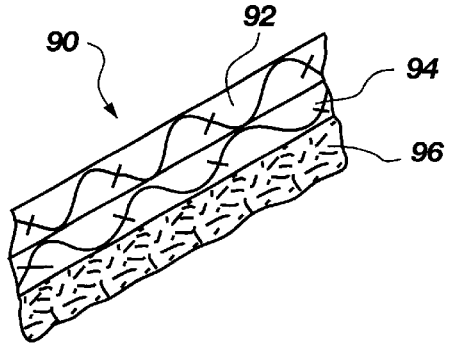
FIG. 6 is a partial cross-sectional view of an alternate configuration of the mask member invention.

In another arrangement better seen in FIG. 6, the mask member 90 is shown in partial cross section. An outer layer 92 may be of any desired fabric and preferably is made of a water resistance stretchable material. The inner layer 94 is made of Spandex™-type material or a similar wind and water resistant light weight and biaxially deformable material. A material is biaxially deformable if it is elastically deformable in two generally normal axes such as an x and y axis in a typical x-y coordinate system. The third or inner layer 96 is here shown made of a fleece material attached to or laminated to the inner material 94.

As hereinbefore noted, a scarf portion 16 may be associated with the head member 14. As here shown, the scarf portion 16 is unitarily formed with the head member 14. Those skilled in the art will recognize that the scarf member may be separately formed and even may be removable from the head member as desired. That is, various zipper, hook and loop, or button arrangements may be used to attach or remove a scarf portion or scarf member. As better seen in FIG. 1, the scarf portion 16 extends from the lower edge 26 of the mask member 12 downwardly a distance 62. The distance 62 may vary based on the desires of the user. However, it is preferably selected so the scarf portion 16 extends below the typical collar sections 64 of a jacket, coat or other garment (shown in phantom in FIG. 1) worn by the user in adverse weather conditions. The lower edge 66 of the scarf portion 16 is generally configured to extend to the shoulders or shoulder area 67 of the user to in turn provide protection for the neck of the user in adverse weather conditions, particularly when involved in body moving activities that cause relative movement between the user's head and shoulders. Skiing, cross-country skiing, snowmobiling and other similar activities involve such body movement.

The mask member 12 and the scarf portion 16 here shown in FIGS. 1 and 2 are formed to contouredly 102 extend under the chin 28 toward the neck area 104 and then downwardly along the neck 106 toward the upper chest area 108 of the user. The mask member 12 and scarf portion 16 are shaped as shown to provide a contoured and comfortable fit over the chin 28 and along the neck under the chin 28. A fit as shown in FIG. 1 is preferred to facilitate ease of movement, minimize access by cold air and snow and to reduce bunching under the collar 64 of related outer wear. In FIG. 1, the scarf portion 16 is shown attached to the lower edge 26 under the chin 28. However, the lower edge 26 may be positioned above the chin 28 with the scarf portion 16 being contoured with the mask member 12 to fit under the chin 28 comparable to that shown in FIGS. 1 and 2.

The head member 14 with the scarf portion 16 may preferably be formed in a left portion 68 and a right portion 70. The left portion 68 and the right portion 70 are joined together at a seam 72 which extends downwardly from the lower edge 26 of the mask member 12 and an upper seam 74 which extends upwardly from the head edge 50 over the top of the head of the user and rearwardly to intersect the lower edge 66. The lower edge 66 may also be basted or formed with a hem 73 to secure the edge 66.

It should be noted that the head member 14 including the scarf portion 16 are formed to have an opening 76 so the article of clothing 10 may be placed over the head of the user and pulled down to position the mask member 12 over the face of the user as generally is illustrated in FIG. 1. In positioning the article of clothing 10 over the head, the user may experience certain elastic deformation of the mask member 12 and the head member 14 as well as the scarf portion 16 to facilitate passage over the head and positioning about the head and face.

It may be noted in FIG. 1 and in FIG. 2, that the opening 18 is positioned to register with the eyes of the user. The opening 18 has a height 78 which is selected to be less than the interior height 79 of the typical opening of the set of sport goggles 80 which may be worn by user in adverse weather conditions. That is, the sport goggles 80 typically have at least an upper edge portion to rest upon the forehead of the user. As here shown, the upper edge 82 of the sport goggles 80 is formed for positioning on the forehead of the user with the upper edge 50 interior or within the area 81 defined by sport goggles 80. The sport goggles 82 here shown have a lower portion or edge 84 that extends over the bridge of the nose which in cooperation with the upper edge 82 define a lens area 86 therebetween. As can be seen, the opening 18 is sized so that the upper edge 20 of the mask member 12 and the head edge 50 of the head member 14 are positioned to be within the interior area 81 of the sport goggles and more specifically interior the upper edge 82 and lower edge 84 of the sport goggles 80.

As more specifically seen in FIGS. 1 and 2, the left edge 30 and the right edge 32 of the mask member 12 extend upwardly 61 to intersect the upper edge 20 at the outside portion 54 and 56 of the opening 18. In turn, the head edge 50 is formed to extend to and interconnect to the upper edge 20. At the point the left edge 30 and right edge 32 intersect the upper edge 20. The interconnection of the upper edge 20, the head edge 50, and the left edge 30 at the outer portion 54 of the opening 18 and the upper edge 20 and the head edge 50 with the right edge 32 at the right outside portion of the opening 56 provides a single point of interconnection and in turn facilitates construction within a minimum of cost and expense.

The description of the above-illustrated embodiments is not intended to limit the scope of the claims which themselves are regarded as essential to the invention.

What is claimed is:

1. A combination of a sport goggle and an article of protective clothing comprising:

sport goggles for positioning over the eyes of a user, said sport goggles having a height, a width and means for holding said sport goggles about the the head of a user; and an article of clothing having a mask member formed of an insulative and wind-resistant material sized to snugly cover a portion of the face of a user and having a middle edge for positioning above the mouth and below the nose of a user, said mask member having a perimeter which includes an upper edge for positioning under the eyes of a user and a lower edge for positioning below the mouth of a user, a head member formed of a closely woven pliable material and sized for positioning about the head of a user, said head member being fixedly connected to said mask member along at least a portion of said perimeter of said mask member excluding said upper edge, said head member and said mask member together being sized to completely surround the head of a user and to define an eye opening to register with the eyes of a user, and said head member having a head edge for positioning above the eyes of a user spaced from said upper edge of said mask member to form said eye opening which has a height less than said height of said protective sport goggles, a scarf portion unitarily formed to be an extension of said head member and extending downwardly from said head member to be positionable around and proximate the neck of a user, said scarf portion being fixedly and non-removably connected to said mask member along a portion of said perimeter of said mask member excluding said upper edge.

* * * * *